United States Patent [19]

Herb

[11] Patent Number: 5,001,821

[45] Date of Patent: Mar. 26, 1991

[54] PITTED ROLL FOR AN OFFSET LITHO PRINTING PRESS

[75] Inventor: Rolf Herb, Frankenthal, Fed. Rep. of Germany

[73] Assignee: Albert-Frankenthal AG, Frankenthal, Fed. Rep. of Germany

[21] Appl. No.: 596,736

[22] Filed: Oct. 15, 1990

Related U.S. Application Data

[60] Continuation of Ser. No. 410,469, Sep. 21, 1989, abandoned, which is a division of Ser. No. 280,443, Dec. 6, 1988, Pat. No. 4,879,791.

[30] Foreign Application Priority Data

Dec. 24, 1987 [DE] Fed. Rep. of Germany ..... 3744131

[51] Int. Cl.[5] ..... B41F 1/46

[52] U.S. Cl. ..... 29/121.2; 29/121.4; 29/121.5; 29/121.6; 29/121.8; 29/121.1; 29/132; 101/141; 101/153; 101/348

[58] Field of Search ..... 29/121.1, 121.2, 121.4, 29/121.5, 121.6, 121.8, 130, 132; 101/141, 153, 348, 349, 350

[56] References Cited

U.S. PATENT DOCUMENTS

| | | | |
|---|---|---|---|
| 4,009,658 | 3/1977 | Heurich | 29/121.2 |
| 4,015,100 | 3/1977 | Gnanamuthu et al. | 29/121.1 |
| 4,301,583 | 11/1981 | Poole | 29/121.4 |
| 4,503,769 | 3/1985 | Anderson | 101/153 |
| 4,601,242 | 7/1986 | Fadner | 101/348 |
| 4,794,680 | 1/1989 | Meyerhoff et al. | 29/132 |
| 4,819,558 | 4/1989 | Counard | 101/348 |

FOREIGN PATENT DOCUMENTS

| | | | |
|---|---|---|---|
| 2049102 | 5/1979 | United Kingdom | 29/121.8 |

*Primary Examiner*—Irene Cuda

*Attorney, Agent, or Firm*—Jones, Tullar & Cooper

[57] ABSTRACT

A pitted roll for an offset litho press inking unit, more especially as part of a short inking unit, has a dual coating layer of which the inner layer is formed of a material such as copper comprising the application of a high affinity for ink and the outer layer is formed of ceramic material to give lands wiped by a doctor, preferably set at a negative angle, around the pits. A high wear resistance and a high accuracy may be achieved if the plain base member of the roll is coated with copper or the like and then with ceramic material, after which engraving takes place to penetrate the ceramic layer right into the copper or the material with an affinity for ink.

2 Claims, 2 Drawing Sheets

PITTED ROLL FOR AN OFFSET LITHO PRINTING PRESS

This is a continuation of co-pending application Ser. No. 07/410,469 filed on Sept. 21, 1989, abandoned, which is a division of application, Ser. No. 07/280,443, filed Dec. 6, 1988, now U.S. Pat. No. 4,879,791.

BACKGROUND OF THE INVENTION

In accordance with one aspect the invention relates to a pitted roll for the inking unit of an offset litho printing press, more particularly a short inking unit, which has pits which are separated from each other by lands containing a ceramic material and having a surface, preferably one of copper, with an affinity for ink, which roll is designed to cooperate with at least one doctor resting on its periphery and preferably set at a negative angle thereto.

A pitted roll of the this type has been proposed in U.S. Pat. No. 4,637,310. In the case of this known arrangement use is made of an engraved base member, which is provided with a dual layer coating following the engraved structure. The clearance width and the depth of the pits produced by engraving the base member are in this case altered by the following coating operation. There is thus the danger of an undesired departure from the desired dimensions, since it is not possible to produce the coating with a perfectly regular, i.e. accurate thickness. Apart from this, in the known arrangement, owing to the coating being carried out after the engraving operation, comparatively broad lands are produced, which is often undesirable. A further fact is that in this respect the lands only consist of ceramic material at their center parts and have borders of comparatively soft material, something that has an unfavorable effect on the resistance to wear which may be obtained. In the known roll the inner layer of the dual coating consists of ceramic material and the outer layer consists of copper, which is removed at the outer face and in the pits is left to form a lining.

SUMMARY OF THE INVENTION

Taking this state of the art as a starting point one object of the invention is to provide a pitted roll of the initially specified type which not only has a high resistance to wear but is also very accurate.

In order to achieve this and other objects, the invention takes as a basis a cylindrical, non-engraved base member, which is provided with a coating made of a material with an affinity for ink, preferably of copper, and contains the pits which are covered at the lands with a ceramic material layer. The pitted roll is to be attained since the non-engraved base member is firstly coated with copper and thereafter with ceramic material and after this engraving takes place so as to penetrate through the ceramic layer and to extend as far as the copper layer.

In this respect the entire peripheral land surface is advantageously made of ceramic material, that is to say of material with a high resistance to wear. The inner part of the pits on the other hand is within the solid copper. The result is thus an extremely wear resistant land surface and pits which take up and convey the ink in an optimum manner. The copper layer and the ceramic layer may each be ground down to size so that the result is a precise thickness of the ceramic layer and excellent centricity. Since the engraving is undertaken as the last working step, there is a highly accurate geometry of the engraved pits. A further advantage of the invention is to be seen in that the inner copper layer may be readily removed so that if the pitted roll should be damaged the entire coating may be removed and renewed in a simple manner.

In accordance with an advantageous further development of the invention it is possible for the copper layer to be produced by electroplating. This is a simple way of providing a copper layer with the desired thickness.

A further advantageous feature of the invention is such that the ceramic layer is applied by plasma spraying. This ensures that during the application of the ceramic layer there is no excessive change in the temperature of the substrate so that the copper layer already present is not impaired.

In accordance with a further development of the invention the engraving may be performed with a laser beam. This feature ensures high accuracy.

Further advantageous features and convenient developments of the invention will be gathered from the ensuing account of one working embodiment thereof as shown in the drawings.

LIST OF THE SEVERAL VIEWS OF THE DRAWINGS

DETAILED ACCOUNT OF WORKING EMBODIMENT OF THE INVENTION

Figure 1:
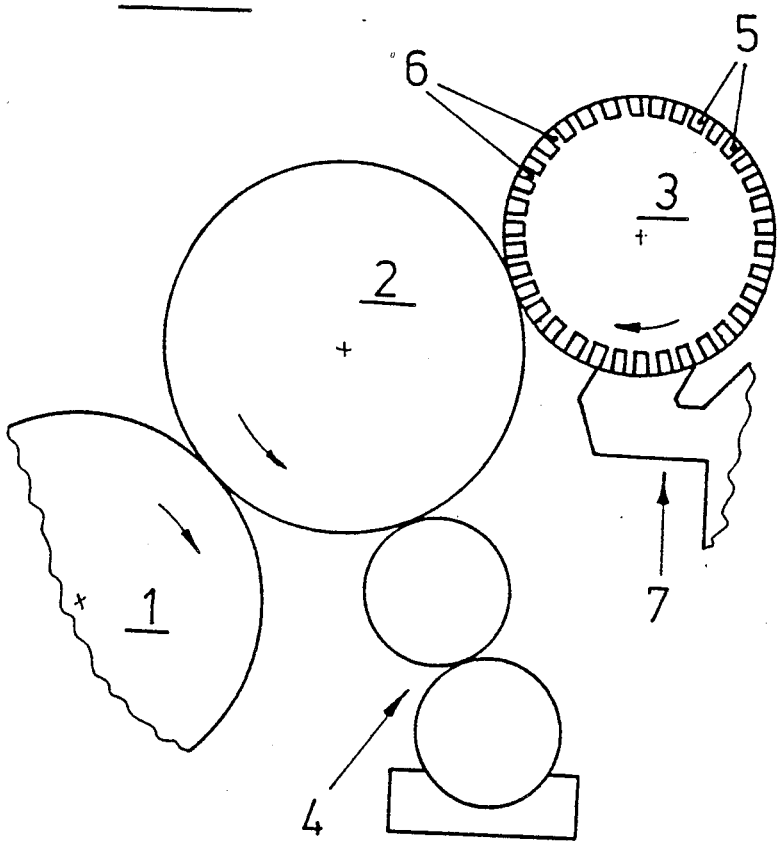
FIG. 1 is a diagrammatic view of a short inking unit for an offset litho press.

The short inking unit as shown in FIG. 1 consists of a plate cylinder 1 adapted for use with hard offset litho printing inks and which is arranged to cooperate with a rubber coated application roll 2 of the same diameter as the plate cylinder 1 and to cooperate with a pitted roll 3 which has a smaller diameter. The application roll 2 simultaneously cooperates with a dampening unit 4. The periphery of the pitted roll 3 is shown in FIG. 1 to indicate the pits 5 in an enlarged fashion together with the lands 6 delimiting the pits 5.

The pits 5 are filled with ink while the lands 6 are stripped of ink by the at least one doctor so that there is a precise metering of the ink in accordance with the capacity of the pits 5. The supply of ink to the pitted roll 3 and the removal of ink therefrom is performed by the fountain doctor 7, which in the present case consists of two doctor blades resting on the pitted roll 3 with a negative angle, such blades defining a fountain or well between them filled with ink.

Figure 2:
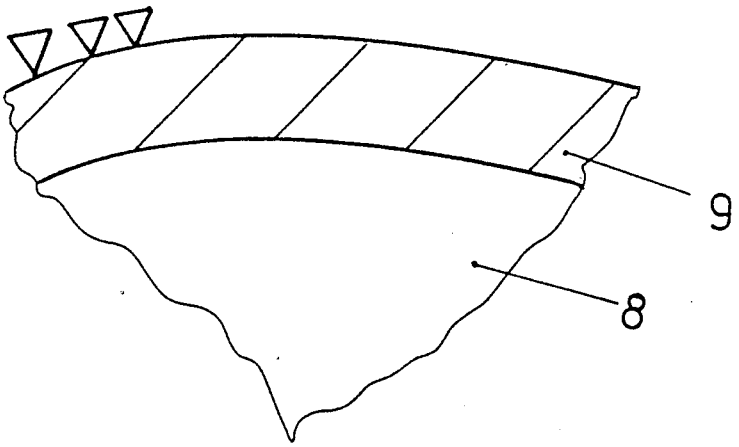
FIGS. 2 through 4 are views of part of the pitted roll in accordance with the invention to show the separate steps in the production thereof.
Figure 3:
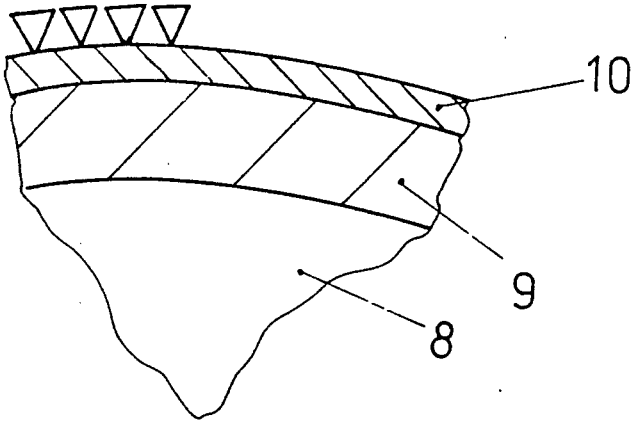
Figure 4:
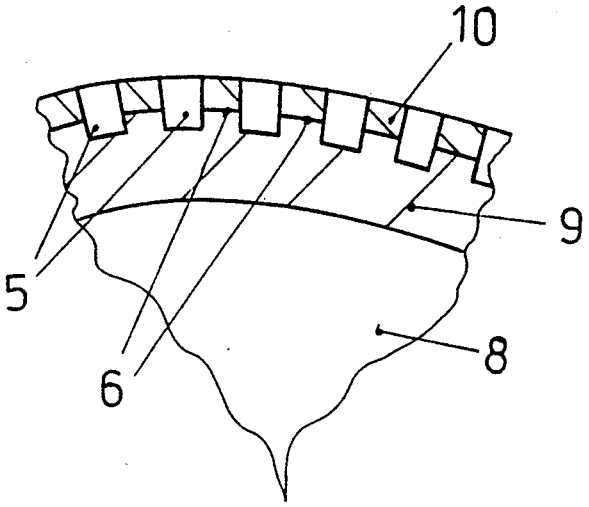

As will be seen from FIGS. 2 through 4, the pitted roll 3 consists of a steel core 8 which may have end journals and is peripherally coated. The steel core 8, which has a cylindrical continuous outer face, is firstly provided with an annular continuous copper layer 9, for instance by electroplating. The thickness of the copper layer 9 amounts to about $50\mu$, this being readily possible if the coating is produced by electroplating. After the production of the copper layer 9 the copper layer is processed by grinding and/or polishing to produce the desired size. This is indicated in FIG. 2 by a processing symbol.

The copper layer after being so worked on its outer surface and accordingly having the desired exact size and an exactly cylindrical form is then furnished with a continuous, annular ceramic layer 10, as indicated in FIG. 3, such ceramic layer for instance being in the form of CrO. This ceramic layer 10 may be applied by plasma spraying. For this purpose an electric arc is produced, which is blown from a nozzle by a gas current containing the ceramic material. This only increases the substrate temperature by about 100° to 200° C. so that the copper layer 9 is not damaged on applying the ceramic layer 10.

After completion of the ceramic layer 10 the same is worked as is indicated in FIG. 3 as well by a symbol, such working comprising grinding and/or polishing, possibly with lapping. The working steps after application of the copper layer 9 and after producing the ceramic layer 10 lead not only to a very high quality surface but also to an exact and perfectly regular thickness of the ceramic layer 10 and to accurate centricity. The thickness of the ceramic layer 10 may be approximately 10μ to 15μ, that is to say a third of the thickness of the copper layer 9.

The dual coated roll member is, as indicated in FIG. 4, peripherally engraved to produce the pits 5. The depth of engraving is so selected that the pits 5 penetrate through the outer ceramic layer 10 and extend into the copper layer 9 without completely penetrating it. Accordingly the inner ends of the pits 5 are in the solid copper. In the case of a design with a thickness of the copper layer 9 of 50μ and of the ceramic layer 10 of 10μ to 15μ the depth of the pits may be about 25μ to 30μ. In the present case it is specifically 28μ. A greater pit depth than 45μ is not desired in practice so that a thickness of the copper layer 9 of 50μ is quite satisfactory.

The engraving of the roll member with its outer surface layer of ceramic material is carried out in a conventional manner using a laser beam, this ensuring a high degree of precision. The lands 6 left by the engraving action, as indicated in FIG. 4, have their entire surface formed by ceramic material and have sharp and wear resistant edges.

During the first engraving operation the laser beam may be so set that it penetrates the ceramic layer and penetrates so far as to reach the desired depth in the copper layer. If the depth of the pits is to be subsequently increased, this may be performed by etching, which as in the case of gravure printing may be done without dismounting the roll from the press. If the pits are to be made smaller, this may be done by electroplating copper. This may accordingly be done to repair the pitted roll to some extent. It is naturally also possible to process the ceramic layer only with the laser beam during the first engraving action and then to etch the copper layer. For this purpose the laser beam is simply so set that it only penetrates through the ceramic layer.

What is claimed is:

1. A pitted roll for an offset litho printing press inking unit, comprising: a cylindrical plain roll member; a layer surrounding the roll member, said layer having an affinity for ink; a ceramic layer surrounding the layer having an affinity for ink; and a plurality of pits formed in the ceramic layer and extending into and exposing a portion of the layer having an affinity for ink, said ceramic layer forming lands between said pits which are wiped by a doctor.

2. The roll as claimed in claim 1, wherein the material having an affinity for ink is copper, the roll is designed for use in a short inking unit and the doctor is set at a negative angle in relation to the roll surface.

* * * * *